US010081992B2

(12) United States Patent
Gerhardt et al.

(10) Patent No.: US 10,081,992 B2
(45) Date of Patent: Sep. 25, 2018

(54) DEVICE FOR CONVEYING AWAY DRILLINGS

(71) Applicant: HERRENKNECHT AG, Schwanau (DE)

(72) Inventors: Tobias Gerhardt, Teningen (DE); Michael Lubberger, Schwanau (DE)

(73) Assignee: Herrenknecht AG, Schwanau (DE)

( * ) Notice: Subject to any disclaimer, the term of this patent is extended or adjusted under 35 U.S.C. 154(b) by 385 days.

(21) Appl. No.: 14/651,170

(22) PCT Filed: Nov. 28, 2013

(86) PCT No.: PCT/EP2013/003594

§ 371 (c)(1),
(2) Date: Sep. 20, 2015

(87) PCT Pub. No.: WO2014/111104

PCT Pub. Date: Jul. 24, 2014

(65) Prior Publication Data

US 2016/0002990 A1 Jan. 7, 2016

(30) Foreign Application Priority Data

Jan. 18, 2013 (DE) ..... 10 2013 000 771

(51) Int. Cl.
*E21B 21/00* (2006.01)
*E21B 7/28* (2006.01)

(52) U.S. Cl.
CPC ..... *E21B 21/00* (2013.01); *E21B 7/28* (2013.01)

(58) Field of Classification Search
CPC ..... E21B 7/006; E21B 27/04
See application file for complete search history.

(56) References Cited

U.S. PATENT DOCUMENTS 1,741,497 A * 12/1929 Boltz ..... E21B 7/201 166/187
2,890,022 A 6/1959 Brown
3,307,644 A * 3/1967 Hill ..... E21B 10/02 175/245
4,176,985 A * 12/1979 Cherrington ..... E21B 7/046 175/61
4,319,648 A 3/1982 Cherrington
5,096,002 A 3/1992 Cherrington
5,209,605 A 5/1993 Cherrington
(Continued)

*Primary Examiner* — Shane Bomar
(74) *Attorney, Agent, or Firm* — Mark Rodgers

(57) ABSTRACT

The invention relates to an apparatus for removing drill cuttings loosened by a drilling tool (113) during the operation of producing a drill hole (101, 102) for laying a pipeline, having at least one pump (12) for pumping out drilling fluid mixed with the drill cuttings, and having at least one receiving body (11) with at least one receiving chamber (17), which is connected to a drill-cuttings region (117) behind the drilling tool (113) via openings (14). It is therefore an object of the invention to create an apparatus for removing drill cuttings which makes it possible for the drill cuttings to be transported away reliably using a pressure-delivery method. The solution of the invention provides, on the receiving body (11), a receiving element (13), which is intended for receiving the drill cuttings mechanically and on which are arranged at least some of the openings (14) via which the drill cuttings pass into the receiving chamber (17).

22 Claims, 15 Drawing Sheets

(56) References Cited

U.S. PATENT DOCUMENTS

Figure 1:
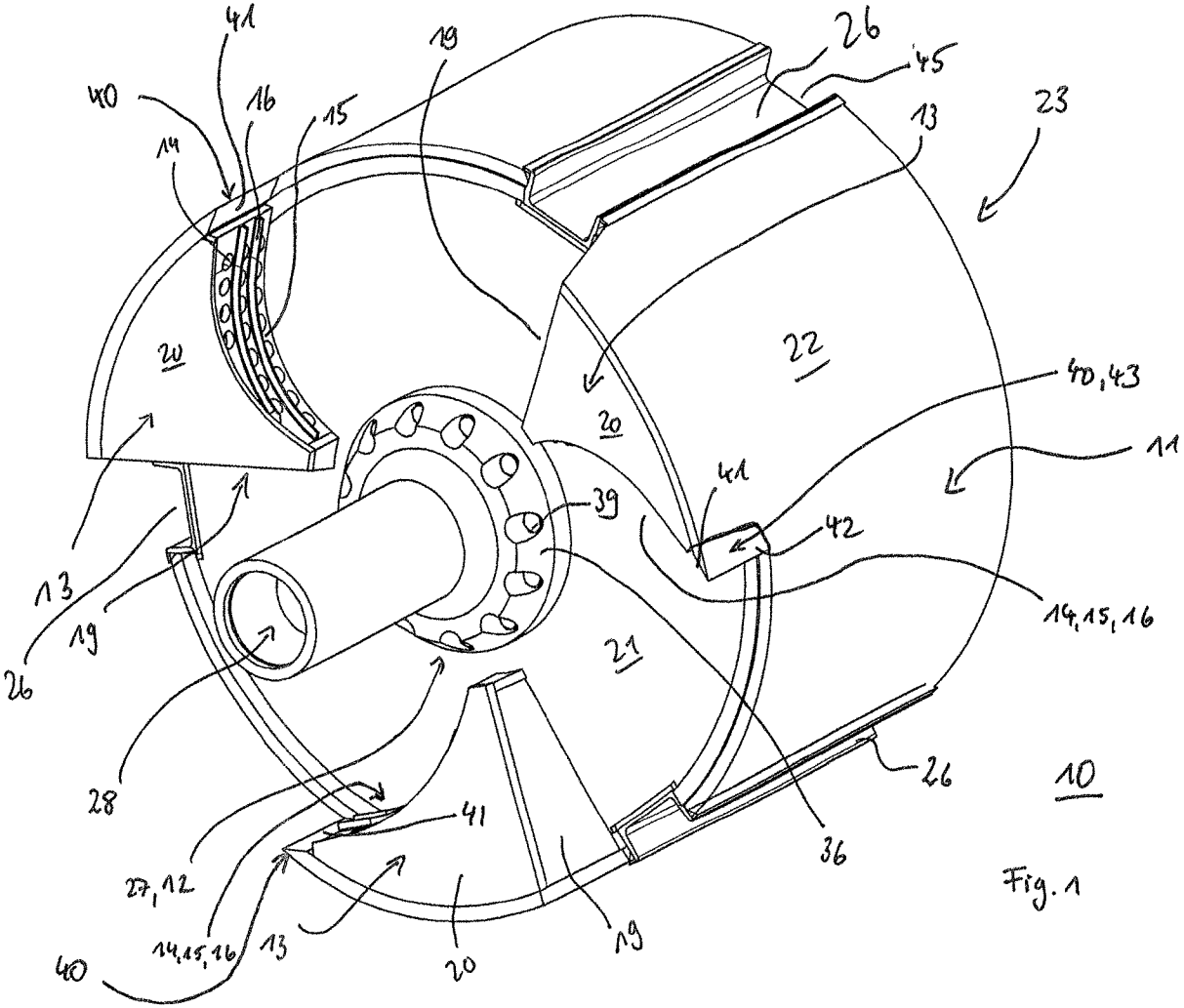

| | | | | |
|---|---|---|---|---|
| 5,351,764 | A | 10/1994 | Cherrington | |
| 5,375,669 | A * | 12/1994 | Cherrington | E21B 7/28 175/102 |
| 6,695,058 | B1 * | 2/2004 | French | E21B 21/002 166/173 |
| 8,011,449 | B2 | 9/2011 | Roth | |
| 2004/0256160 | A1 | 12/2004 | Fonseca | |
| 2014/0151126 | A1 * | 6/2014 | Stimpfle-Ziegler | E21B 7/006 175/57 |
| 2014/0326510 | A1 * | 11/2014 | Wessel | E21B 34/14 175/61 |

* cited by examiner

Stand der Technik

DEVICE FOR CONVEYING AWAY DRILLINGS

DESCRIPTION

The invention relates to an apparatus for removing drill cuttings loosened by a drilling tool during the operation of producing a drill hole for laying a pipeline, having at least one pump for pumping out drilling fluid mixed with the drill cuttings, and having at least one receiving body with at least one receiving chamber, which is connected to a drill-cutting region behind the drilling tool via openings.

Such an apparatus is known from U.S. Pat. No. 5,269,384. This document discloses a method and an apparatus for widening and cleaning a drill hole. A pilot bore hole is produced here by means of horizontal directional drilling (HDD). A scraper is then fitted onto the pilot drill string. A pipeline corresponding essentially to the diameter of the pilot drill string is provided downstream of the scraper. A liquid jet pump is provided in order to remove the earth loosened by the scraper, said pump being driven via drilling fluid flowing in the drill string. The negative pressure occurring on the suction side of the pump causes the drill cuttings to be taken in by suction downstream of the scraper and transported away through the pipeline.

The apparatus here comprises an essentially cylindrical receiving body with a receiving chamber. The receiving body comprises, on its outside, openings which allow through-passage of the drilling fluid with the drill cuttings. The through-passage takes place by virtue of the fluid being taken in by suction, along with the drill cuttings, as a result of the negative pressure existing in the liquid jet pump.

One problem with this configuration is that the openings block up as a result of drill cuttings which are larger than the surface area of the opening. There is also the problem that, depending on the earth and on the composition of the drilling fluid, the openings likewise block up as a result of deposits. In order to overcome this problem, the interior of the receiving chamber contains a roller which is provided with protrusions and rotates over the inside of the outer wall of the receiving chamber, the protrusions entering into the openings and freeing the same again. This solution has the disadvantage that the situation where the openings are actually freed again cannot be achieved with sufficient precision.

It is therefore an object of the invention to create an apparatus for removing drill cuttings which makes it possible for the drill cuttings to be transported away reliably using a hydraulic delivery method.

The solution of the invention provides, in the receiving body, a receiving element, which is intended for receiving the drill cuttings mechanically and on which are arranged at least some of the openings via which the drill cuttings pass into the receiving chamber.

It is advantageous here that the drill cuttings, rather than being taken in by suction, pass via a mechanical receiving means into the receiving chamber, from which they can then be removed hydraulically. It is also advantageous here that the size of the openings corresponds to the maximum particle size which can be delivered by the pump. Classification of the drill cuttings is readily achieved as a result.

A further teaching of the invention provides that the surface area of the openings is configured such that the drill cuttings can pass through the opening preferably without suction-intake action and/or at a low flow speed. This avoids corresponding caking on the walls of the openings and adherence of excessively large drill cuttings.

A further teaching of the invention provides, in the receiving chamber, a suction-intake opening for the hydraulic suction intake of the drill cuttings into the pump. This readily makes it possible to ensure removal from the receiving chamber itself.

A further teaching of the invention provides for at least two receiving elements and/or for at least two receiving chambers. The removal efficiency of the apparatus is improved by the increase in the number of receiving elements and receiving chambers.

Further teaching of the invention provides that the receiving body is a float with at least one air-filled portion. This means that there is less ballast on the drill string, and therefore downward movement is reduced. It is also the case that there is less pressure acting on the earth and the torque produced by the apparatus according to the invention is reduced.

A further teaching of the invention provides that the diameter of the receiving body corresponds essentially to the diameter of the drill hole which is to be drilled in each case. The drilling tool is thus centered to better effect in the drill hole.

A further teaching of the invention provides that the receiving body has at least one bypass for bypassing the receiving body. It is particularly preferred here for the bypass to have a helical and/or rectilinear portion, and/or for the bypass to be arranged on the rear side of the receiving element, and/or for the bypass to be arranged on the outside of the receiving body. The bypass channels allow various modes of use of the apparatus according to the invention. It is thus possible, as a result of blockage at one end of the haulage way, to achieve back-flushing through the openings. The drilling fluid which then exits through the openings into the drill-hole region can then escape into the drill hole via the bypass. Arranging the bypass on the rear side of the receiving elements hinders undesired through-passage of the drill cuttings through the bypass into the downstream drill hole. Furthermore, providing a bypass makes it possible for drill cuttings which cannot pass through the openings to pass through the bypass into the downstream drill hole.

A further teaching of the invention provides that the bypass has a receiving tool on the rear side of the receiving body, and/or that the bypass is in a form which minimizes the through-passage of drill cuttings during drilling operation and which promotes the through-passage of drill cuttings during removal operation. The bypass here is preferably a helical bypass which bends in a direction counter to the direction of rotation of the drilling operation. This means that it is also possible for drill cuttings which cannot be received by the receiving elements to be removed from the receiving region.

A further teaching of the invention provides that the pump is a liquid jet pump. It is particularly preferable here for the liquid jet pump to have a nozzle, a diffuser and a mixing chamber, wherein the nozzle is configured such that it can be moved in relation to the diffuser in order to close the mixing chamber. This makes it possible to flush blockages within the drill string through which the drilling fluid mixed with drill cuttings is transported away.

A further teaching of the invention provides that the receiving element has a receiving tool, which is of preferably releasable configuration. A further teaching of the invention provides that the receiving body is arranged in a releasable manner on the pump, and therefore the receiving body can be changed over in dependence on the diameter of the drill hole which is to be produced. A further teaching of the invention provides that the receiving element is arranged in a releasable manner on the receiving body, and therefore the receiving element can be changed over in dependence on the earth in which the drill hole is to be produced, and/or that a receiving tool arranged on the receiving element is arranged in a releasable manner. The release capabilities mean that the apparatus according to the invention can be adapted readily to the respective drill-hole sizes and/or the nature of the earth.

A further teaching of the invention provides that the drilling tool is arranged on a drilling apparatus and/or on the receiving body, preferably on the receiving element.

A further teaching of the invention provides a drilling apparatus having an apparatus of the type described above.

A further teaching of the invention provides for use of an above-described apparatus, with drilling tools arranged thereon, in the form of a drilling apparatus.

Figure 2:
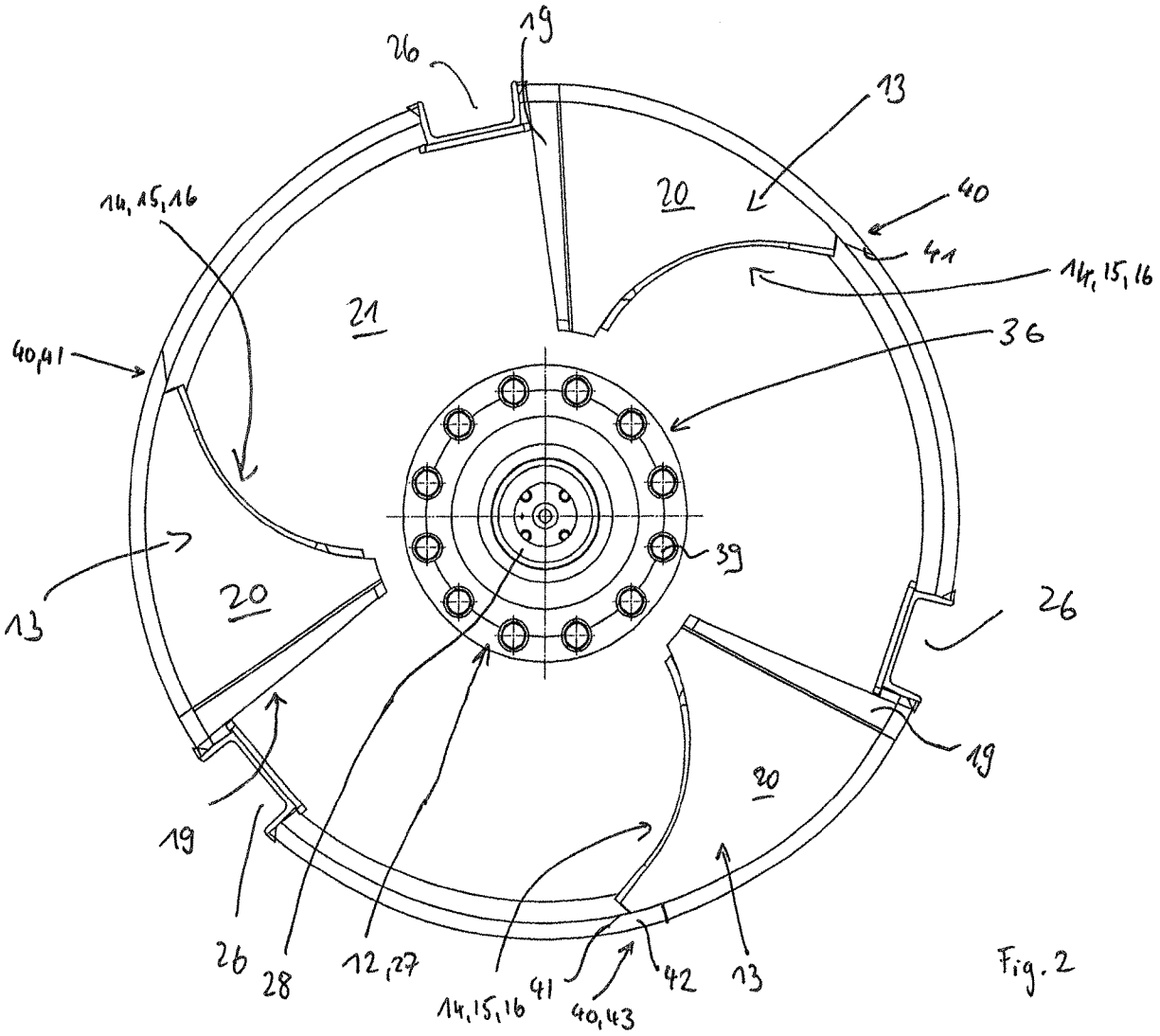
Figure 3:
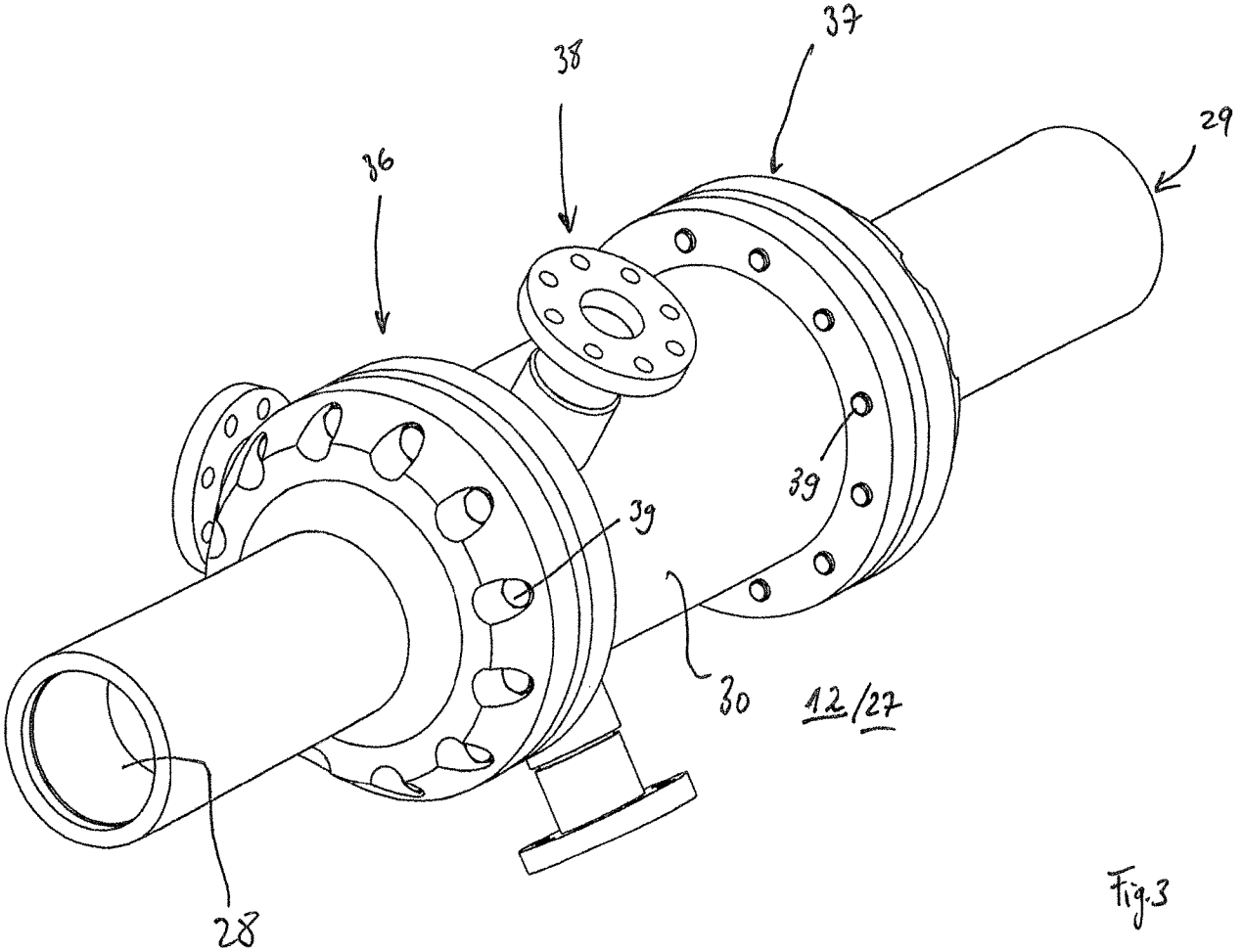
Figure 4:
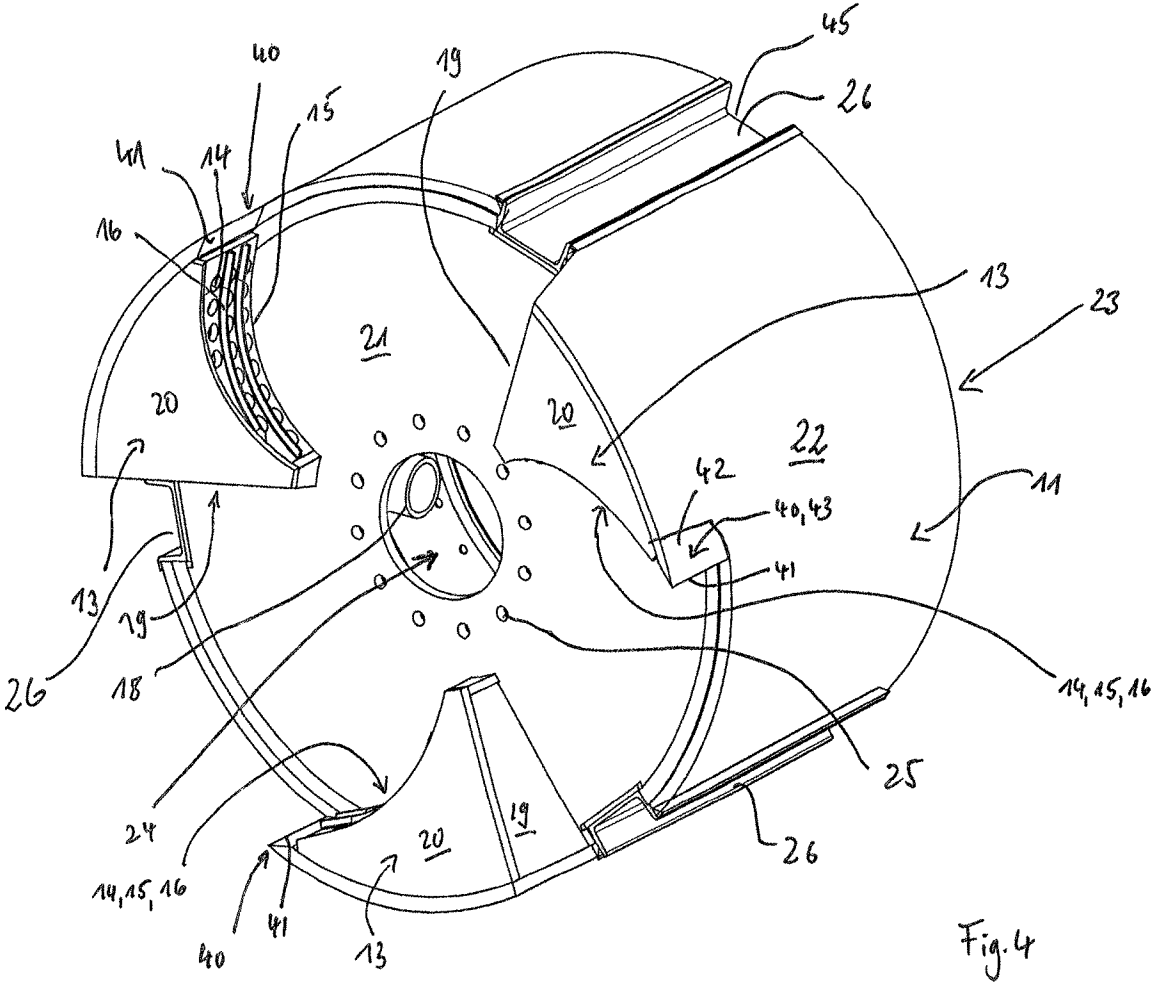
Figure 5:
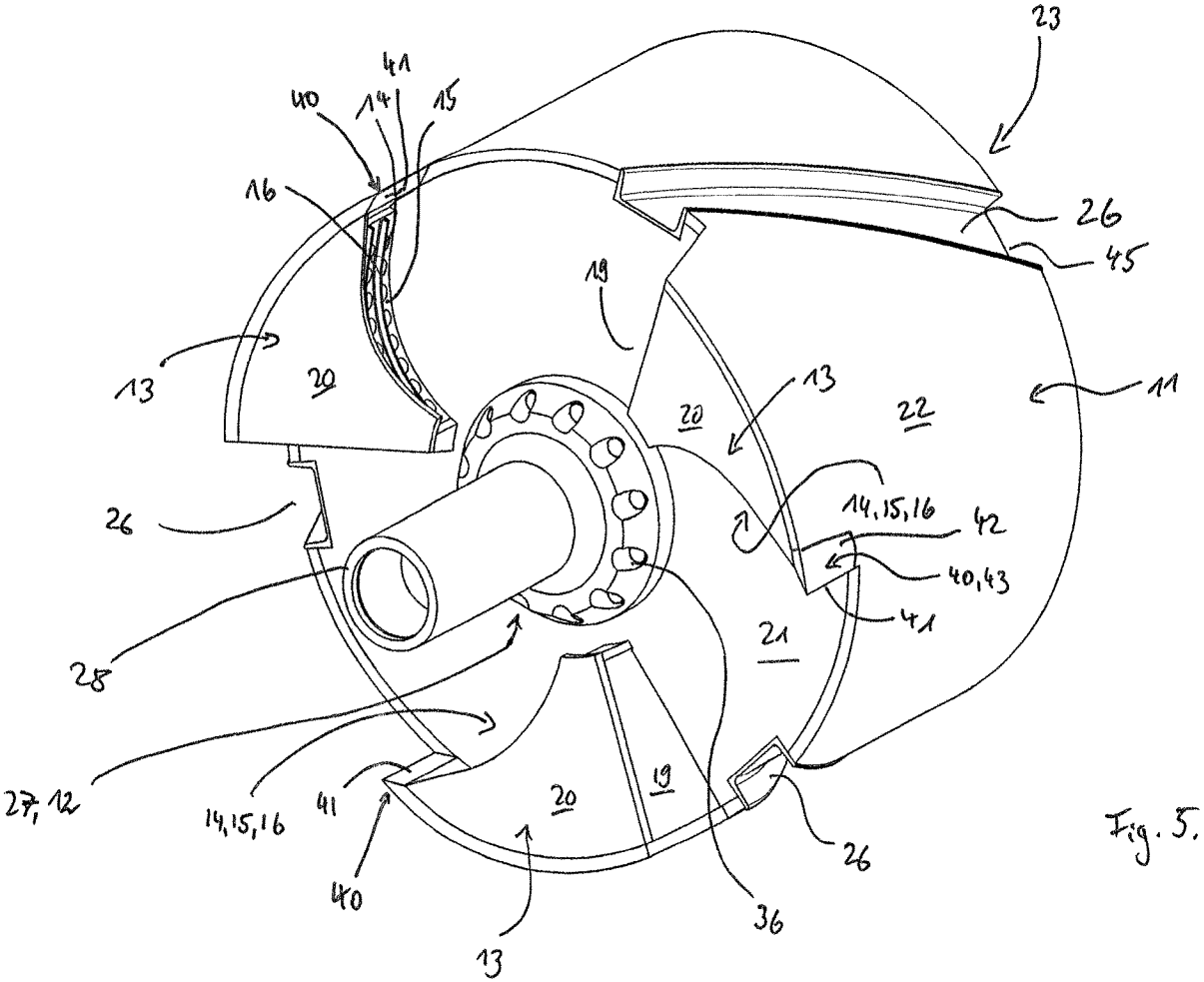
Figure 6:
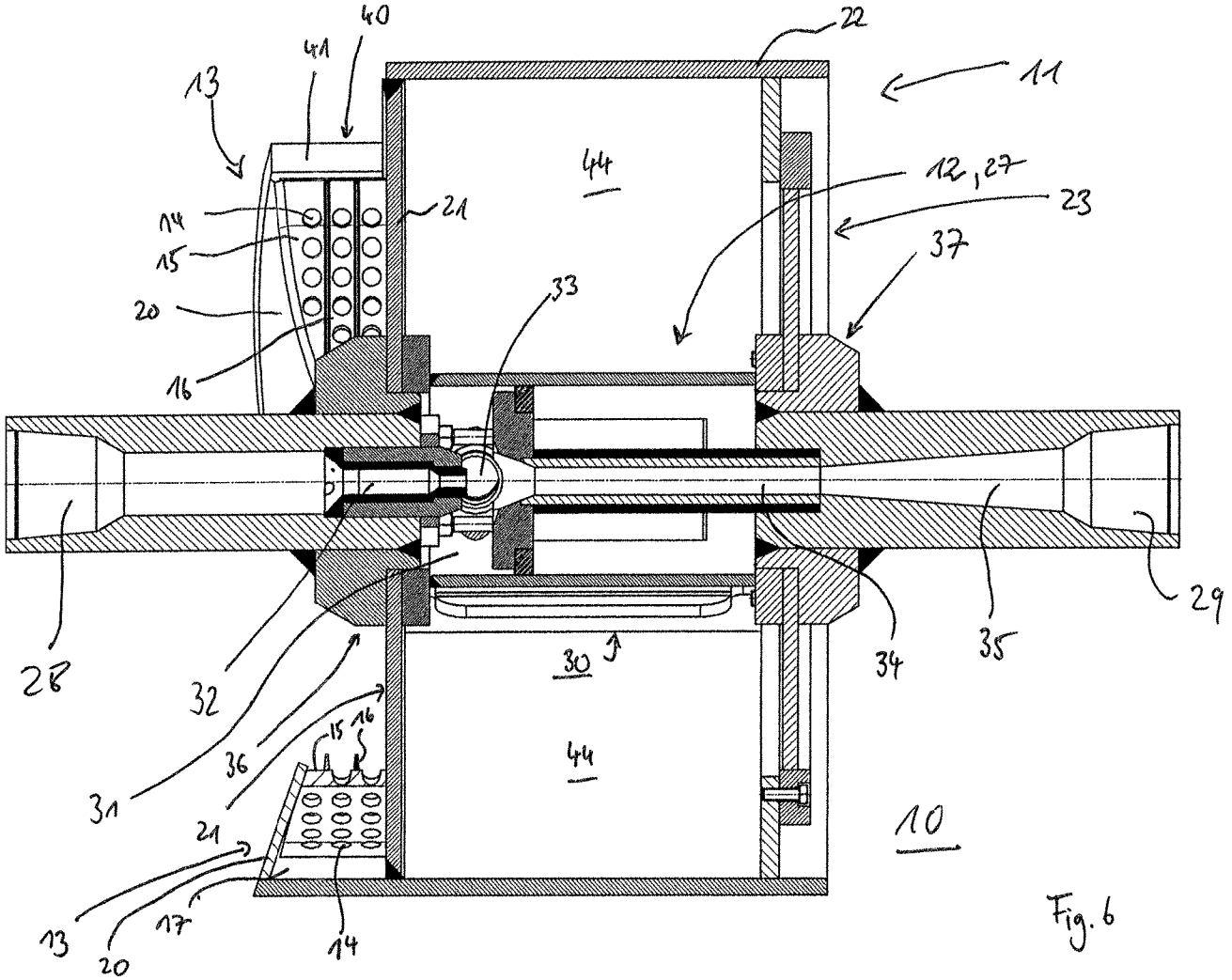
Figure 7:
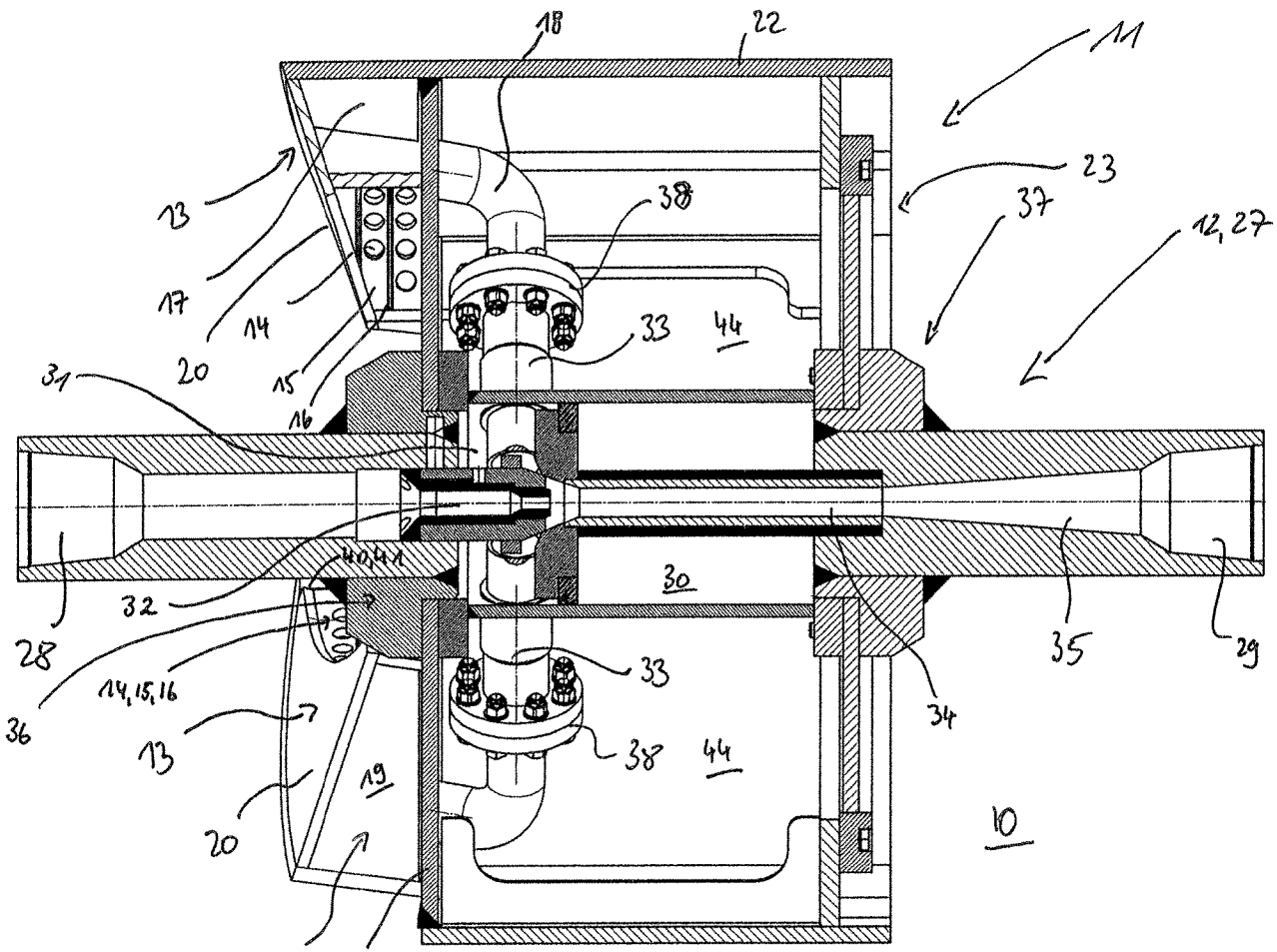
Figure 8:
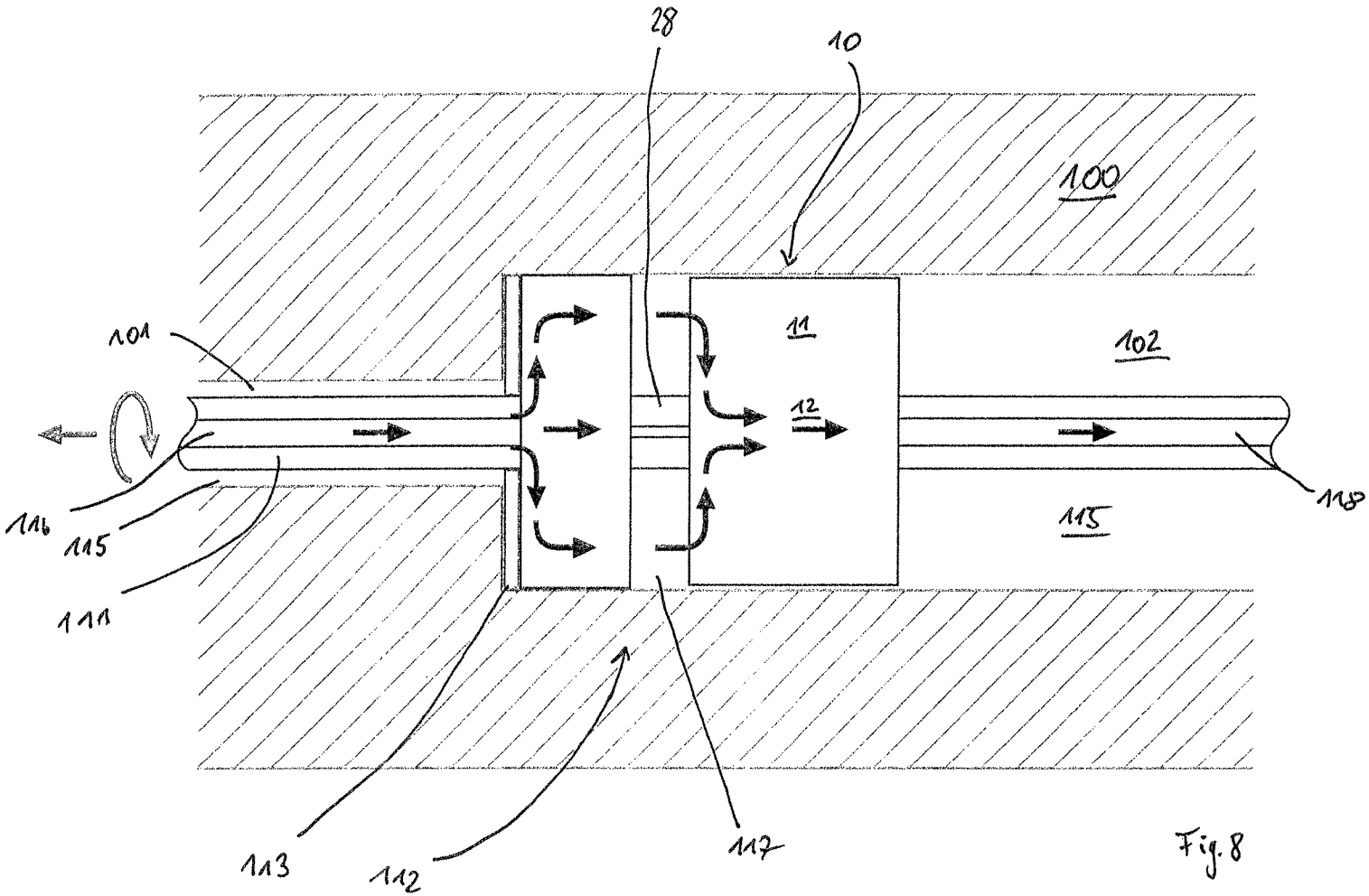
Figure 12:
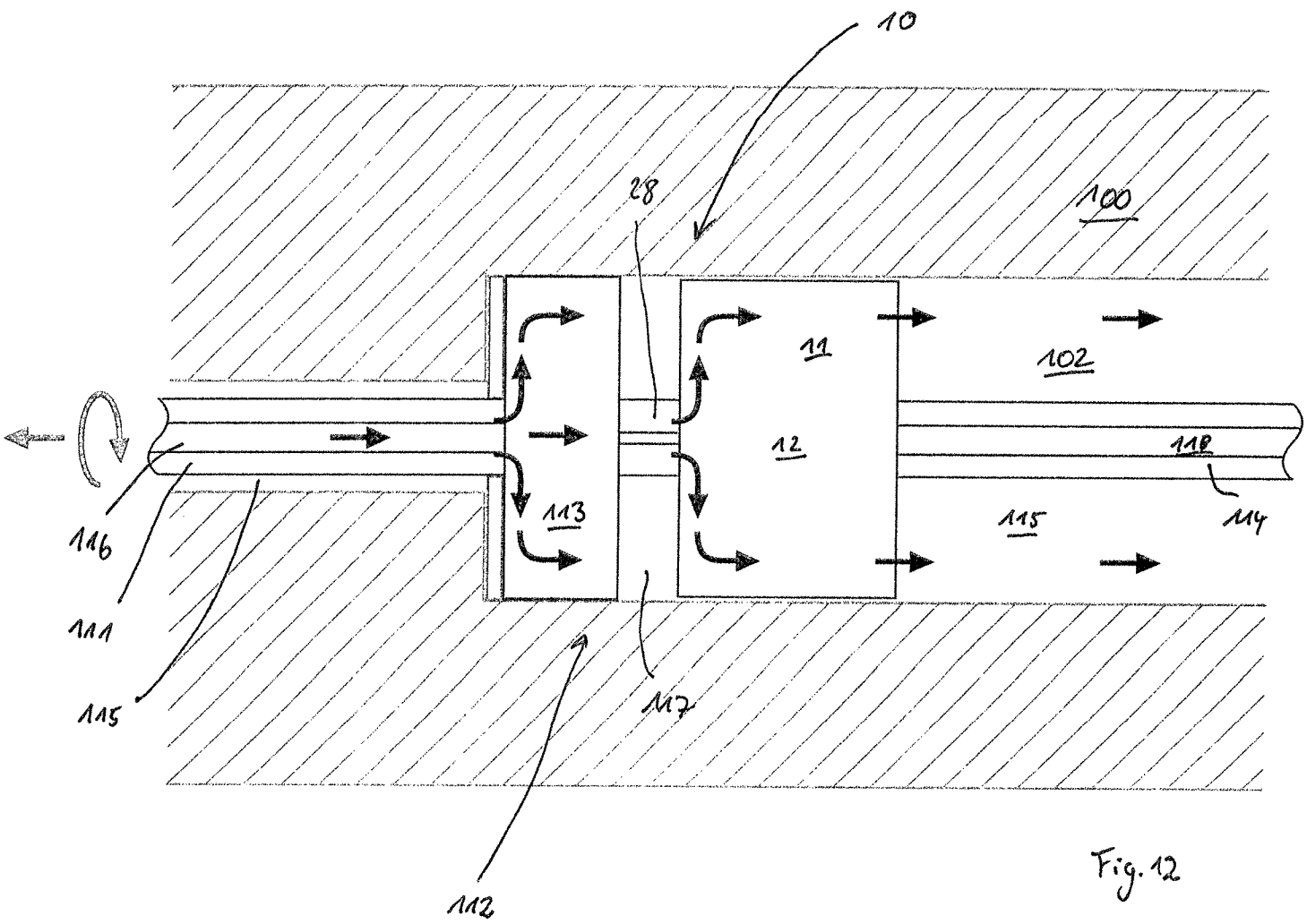
Figure 13:
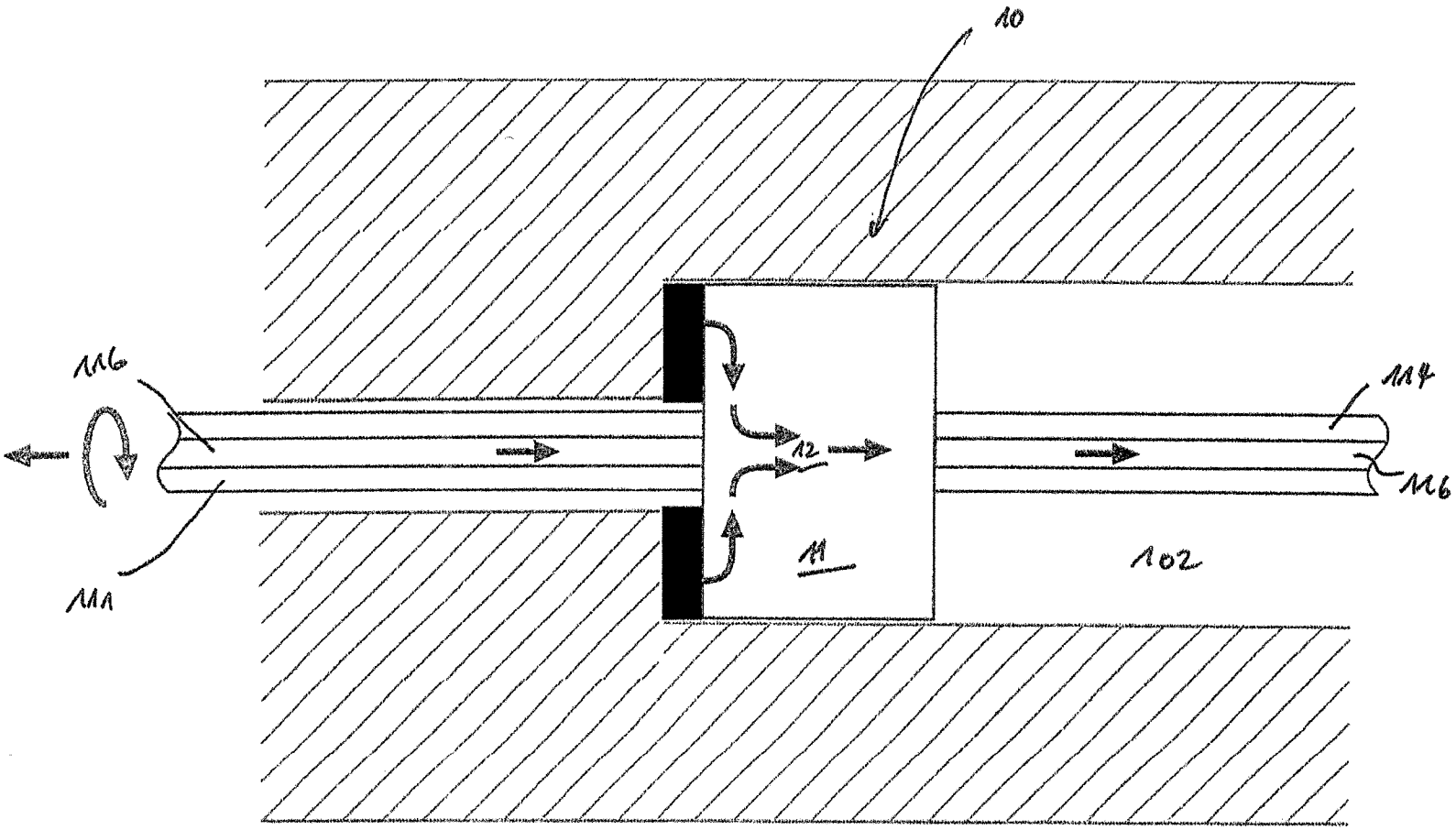
Figure 14:
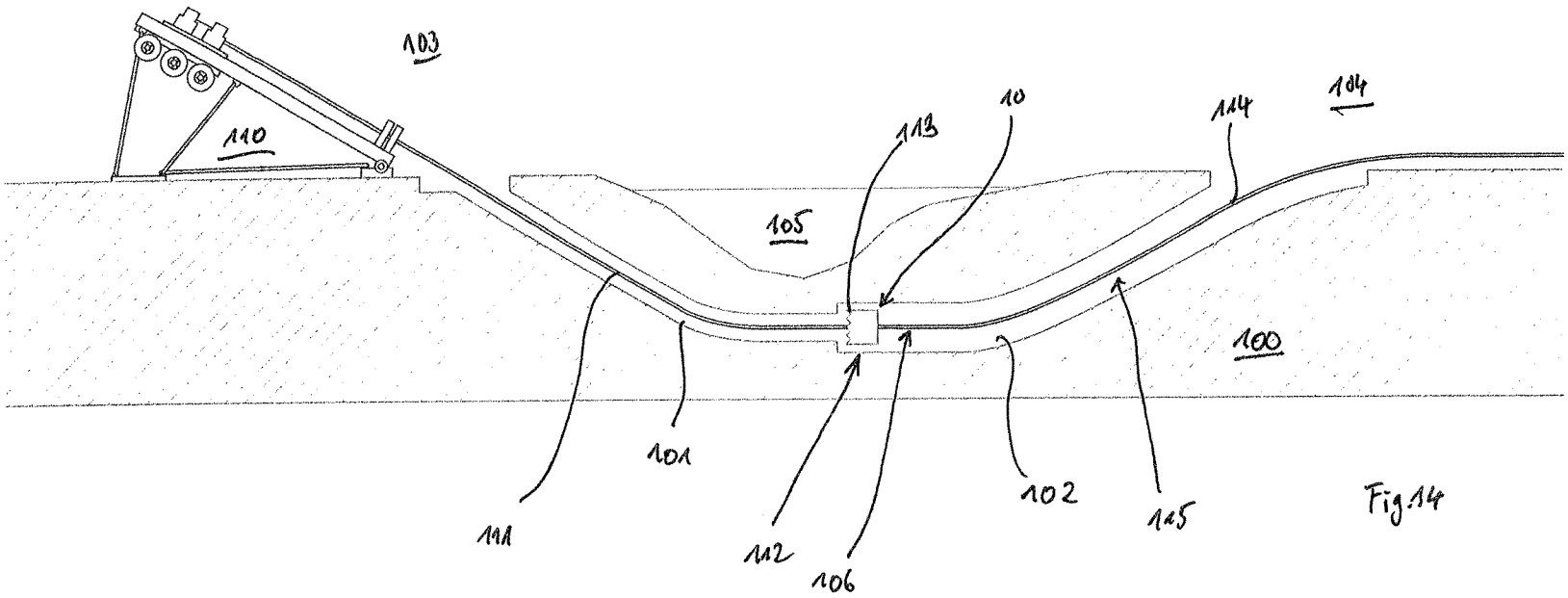
Figure 15:
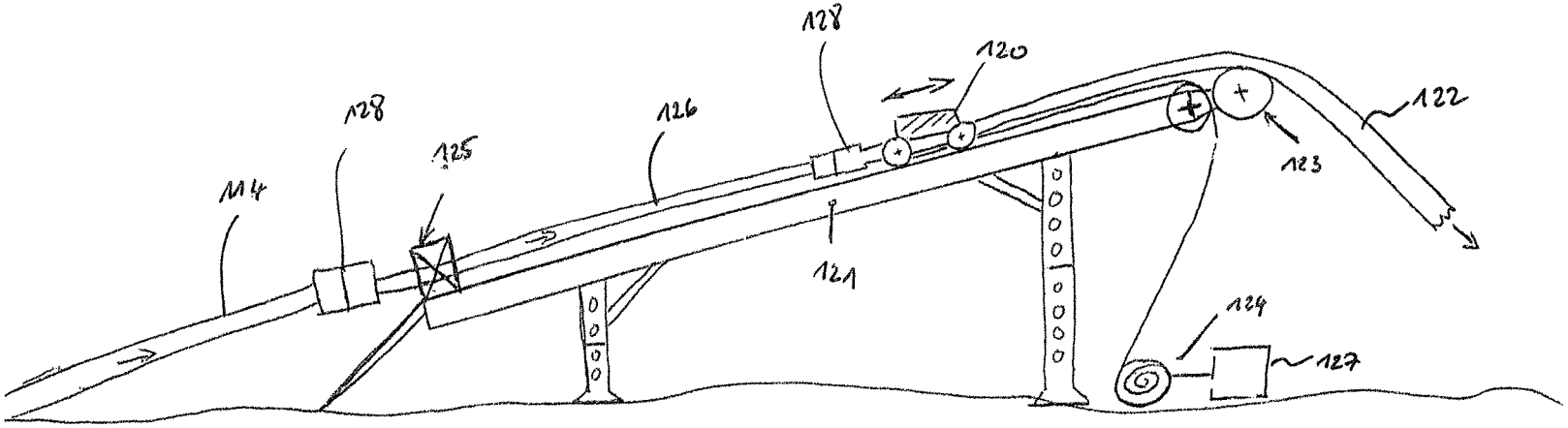

The invention will be explained in more detail hereinbelow with reference to a drawing, in which:

FIG. 1 shows a three-dimensional illustration of the apparatus according to the invention, FIG. 2 shows a front view relating to FIG. 1, FIG. 3 shows a three-dimensional illustration of a liquid jet pump, FIG. 4 shows a three-dimensional illustration of a first embodiment of a receiving body according to the invention, FIG. 5 shows a three-dimensional illustration of a second embodiment relating to FIG. 1, FIG. 6 shows a sectional view relating to FIG. 1, FIG. 7 shows a second sectional view relating to FIG. 1, FIGS. 8-13 show various operating and use states relating to FIG. 1, FIG. 14 shows a schematic diagram of the apparatus according to the invention being used according to the invention, and FIG. 15 shows a supplement to FIG. 14.

FIG. 14 shows an apparatus 10 according to the invention being used according to the invention. In this case, a drill hole 101, 102 is produced in earth 100 (earth is understood to mean, hereinbelow, both solid rock and loose rock), beneath an obstruction 105, from a starting point 103 to a destination point 104. A pipeline (not illustrated) is introduced into the drill hole 101, 102, following completion of the drilling operation. A drilling rig 110 is provided in order to produce the drill hole 101, 102. From the drilling rig 110, a drill bit (not illustrated) is moved forward along the drilling line 106 of the drill hole 101, 102, with a drill string 111, from a starting point 103 to a destination point 104 by virtue of the drill bit (not illustrated) being advanced by successive installation of new drill-string sections. Once the destination point 104 has been reached, the drill bit (not illustrated) is separated from the drill string 111. A drilling apparatus 112 is then fitted on the drill string 111. The drilling apparatus 112 is made up of a drill bit 113 and of the apparatus 10 according to the invention. A further drill string 114 is fitted on the drilling apparatus 112. By virtue of the first drill string 111 being pulled through the drilling rig 110 at the starting point 103, the drilling apparatus 112 is pulled back along the drilling line 106 for example from the destination point 104 to the starting point 103. The first drill string 111 is gradually removed in this way and the second drill string 114 is correspondingly installed. The drilling apparatus 112, depending on the type of earth, is provided with a drill bit 113 of which the diameter corresponds to the end diameter of the drill hole 101, 102 or use is made, one after the other, of differently sized drilling apparatuses with diameters of different sizes, so that the drill hole 101, 102 is widened to the desired diameter in a number of passes. Following completion of the widening operation, the pipeline which is to be laid (not illustrated) is then introduced into the drill hole 101, 102. The drill hole 101, 102 here is filled with a drilling fluid 115. The task of the drilling fluid 115 is to keep the drill hole 101, 102 open and, at the same time, to transport away out of the drill hole the drill cuttings loosened by the drilling apparatus 112. The method described here is referred to as Horizontal Directional Drilling (HDD).

FIG. 1 shows the apparatus 10 according to the invention. The apparatus 10 comprises a receiving body 11 and a pump 12. Receiving elements 13, which are provided with openings 14, are provided on the receiving body 11. The openings 14 here are located on a radially outwardly curved receiving surface 15. Directing elements 16 are provided on the receiving surface 15, and these give rise to the drill cuttings being fed to better effect to the openings 14. In the embodiment illustrated, the directing elements 15 are configured in the form of metal plates. These can be adapted in dependence on the earth/rock which is to be loosened. The interior of the receiving element 13 contains within it a receiving chamber 17 (see FIG. 7), which is connected to a suction-intake connection 18 in the direction of the interior of the receiving body 11. The receiving chamber 17 is formed by a rear chamber wall 19, an end wall 21 of the receiving body 21, a cylinder wall 22 of the receiving body 11 and a side chamber wall 20, which forms a front surface, and the receiving surface 15. The suction-intake connection 18 extends through the end wall 21. The receiving body 11 itself is formed by the end wall 21, on which the receiving elements 13 are located, and the cylinder wall 22 and also a corresponding rear wall 23. An opening 24 is provided in the center of the end wall 21, at the point of rotation (see FIG. 4). Bores 25 are provided radially around the opening 24.

The outside of the receiving surface 15 has provided on it receiving tools 40 which either are integrated in the cylinder surface 22, a portion 41 in front of the exception surface 15 being of beveled configuration, or are configured in the form of separate receiving-tool elements 42, likewise with a beveled portion 41, arranged in front of the receiving surface 15, integrated in a cutout 43 in the cylinder surface 22. These receiving tools 40 allow usage in the form of a stripping tool, without being combined with a drill bit 113, in order for deposited drill cuttings to be removed from the drill hole 101, 102 in a specific stripping step. Both variants are illustrated in FIG. 1. In addition, the receiving tools 40 may also be configured in the form of drilling tools (not illustrated). This is not illustrated in the drawings. As an alternative, it is likewise possible for drilling tools to be provided on the receiving body 11 or on the receiving element 13, in which case the apparatus 10 can then also be used in the form of the drilling tool. For this purpose, it is necessary to provide an outlet for drilling fluid (not illustrated) on the drill string 111 or on the drill-string connection 28, in order for drilling fluid to be fed to the drilling region.

The cylinder wall 22 of the receiving body 11 contains bypasses 26, which are either rectilinear or curved (see FIG. 5). The bypass 26 extends over the entire length of the cylinder wall 22. The bypass 26 is arranged behind the rear chamber wall 19, in order to prevent the drill cuttings from entering into the bypass 26 during normal operation of the apparatus 10. It is likewise possible to provide, at the exit 45 of the bypass 26, receiving tools (not illustrated) for receiving earth or drill cuttings, and by means of which, when the apparatus 10 is being removed, said earth/drill cuttings is/are received in the drill hole 102 and transferred into the bypass and then delivered past the receiving body 11, through the bypass 26, into the drill-cuttings region 117. It is a positive thing here if the bypass 26 is helical or curved, in order to promote transportation of the earth/drill cuttings out of the drill hole 102 into the drill-cuttings region 117.

The apparatus 10 also comprises a pump 12, which in the present exemplary embodiment is configured in the form of a so-called liquid jet pump 27. The pump 12, 27 comprises a respective drill-string connection 28, 29 for the drill string 111, 114. A central part 30 of the pump 27 contains a nozzle 32 and suction-intake connections 33 for connection to the suction-intake connection 18 of the receiving chamber 17. The mixing chamber 31 is followed by a mixing tube 34. The mixing tube 34 is followed by a diffuser 35. The drill-string connections 28, 29 are connected to the central part 30 via flanges 36, 37. The suction-intake connections 33 are likewise provided with a flange 38, which serves for connecting to the suction-intake connection 18 of the receiving chamber 17.

The central part 30 of the pump 12, 27 is inserted into the opening 34. The drill-string connections 28, 29 are connected to the central part 30 of the pump 12, via the flanges 36, 37, using bolts 39.

FIG. 6 shows the nozzle 32 in the normal-operating position, and therefore the mixing chamber 31 is in hydraulic connection with the mixing tube 34 and the suction-intake connections 33. In FIG. 7, the nozzle 32 has been moved into the mixing chamber 31, and therefore it is connected to the mixing tube 34, in which case there is hydraulic separation between the mixing tube 34 and mixing chamber 31 and the associated suction-intake connections 33. The nozzle here is subjected to the action of a spring (not illustrated) and secured by a bolt (not illustrated). If a limit pressure to which the nozzle is subjected via the drilling fluid is exceeded, the bolt loosens and the nozzle 32 is moved forward counter to the spring. If the pressure in the fluid drops again, the spring moves the nozzle 32 back into the starting position. A buoyancy space 44 is provided in the interior of the receiving body 11.

FIGS. 8 to 13 show various operating states in conjunction with the apparatus 10 according to the invention.

In the normal operating state (FIG. 8), the nozzle 32 is in the open position. The drilling fluid 115 flows through the interior 116 of the drill string 111 to the drilling apparatus 112 and exits at the drill bit 113 via nozzles (not illustrated). By way of the drilling fluid 115, the drill cuttings at the point of engagement of the drill bit 113 with the earth 100 are flushed away and pass into a drill-cuttings region 117 behind the drill bit 113. The apparatus 10 comprising the pump 12 and receiving body 11 is arranged behind the drill bit 113. Via the receiving elements 13, the drill cuttings are received mechanically, for example via the receiving tools 40, and pass through the openings 14 on the receiving surfaces 15 and into the receiving chamber 17. Some of the drilling fluid 115 is directed through the drill bit 113 and passes, via the drill-string connection 28, into the pump 12, 27. The nozzle 32 accelerates it through the mixing chamber 31 into the mixing tube 34, and this gives rise to a negative pressure in the mixing chamber 31, in which case the drill cuttings located in the receiving chamber 17, together with the drilling fluid 115 located there, are taken in by suction, via the suction-intake connection 18 and the suction-intake connection 33, into the mixing chamber 31 and, there, are entrained into the mixing tube 34 by the drilling fluid accelerated through the nozzle 32. It is then delivered through the interior 118 of the drill string 114 and, following through-passage through the diffuser 35, out of the drill hole 101, 102.

Figure 9:
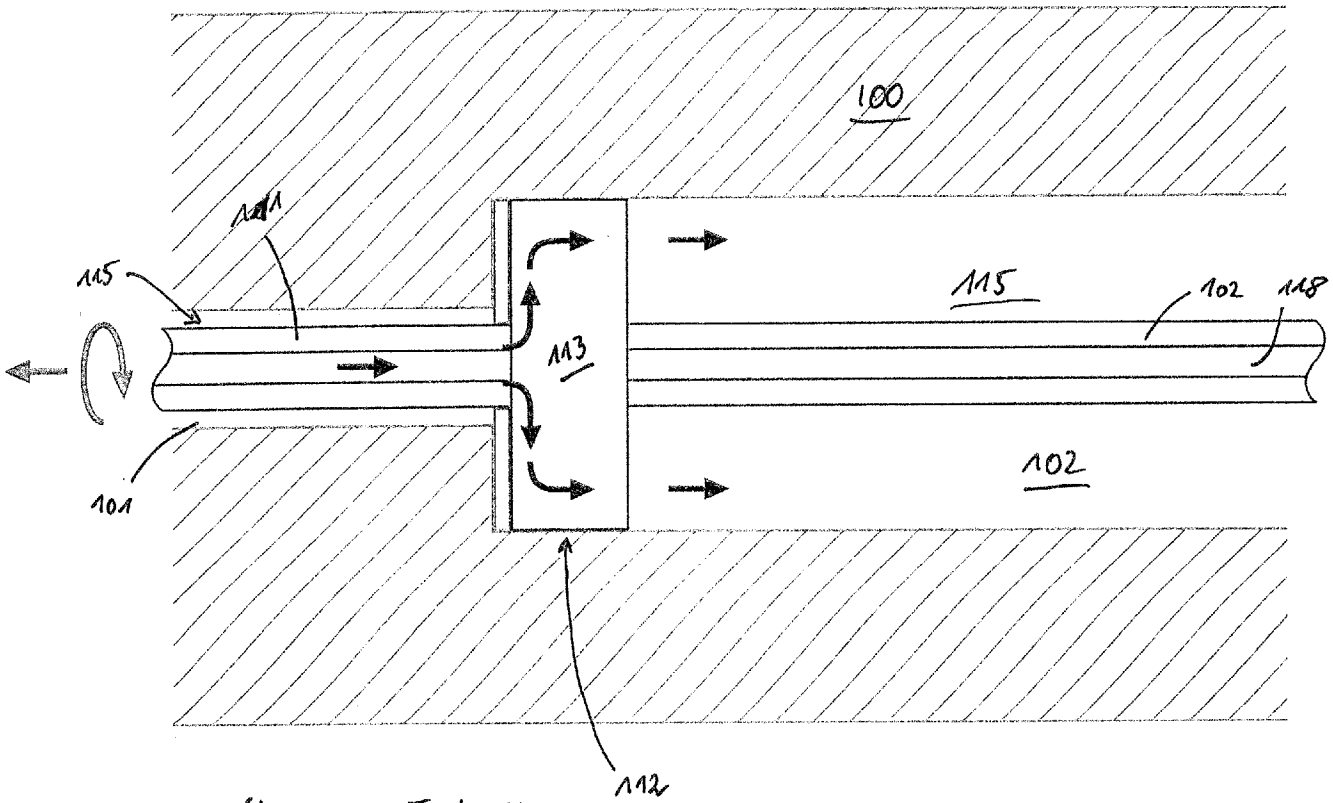

FIG. 9 shows the prior-art operating state, in which use is made of a drill bit without the apparatus 10. The drilling fluid here is discharged to the drill bit 113 and introduced from there, together with the drill cuttings, into the drill hole 102, from where the drilling fluid 115, together with the drill cuttings, exits from the drill hole at low speed. This is the conventional HDD process.

Figure 10:
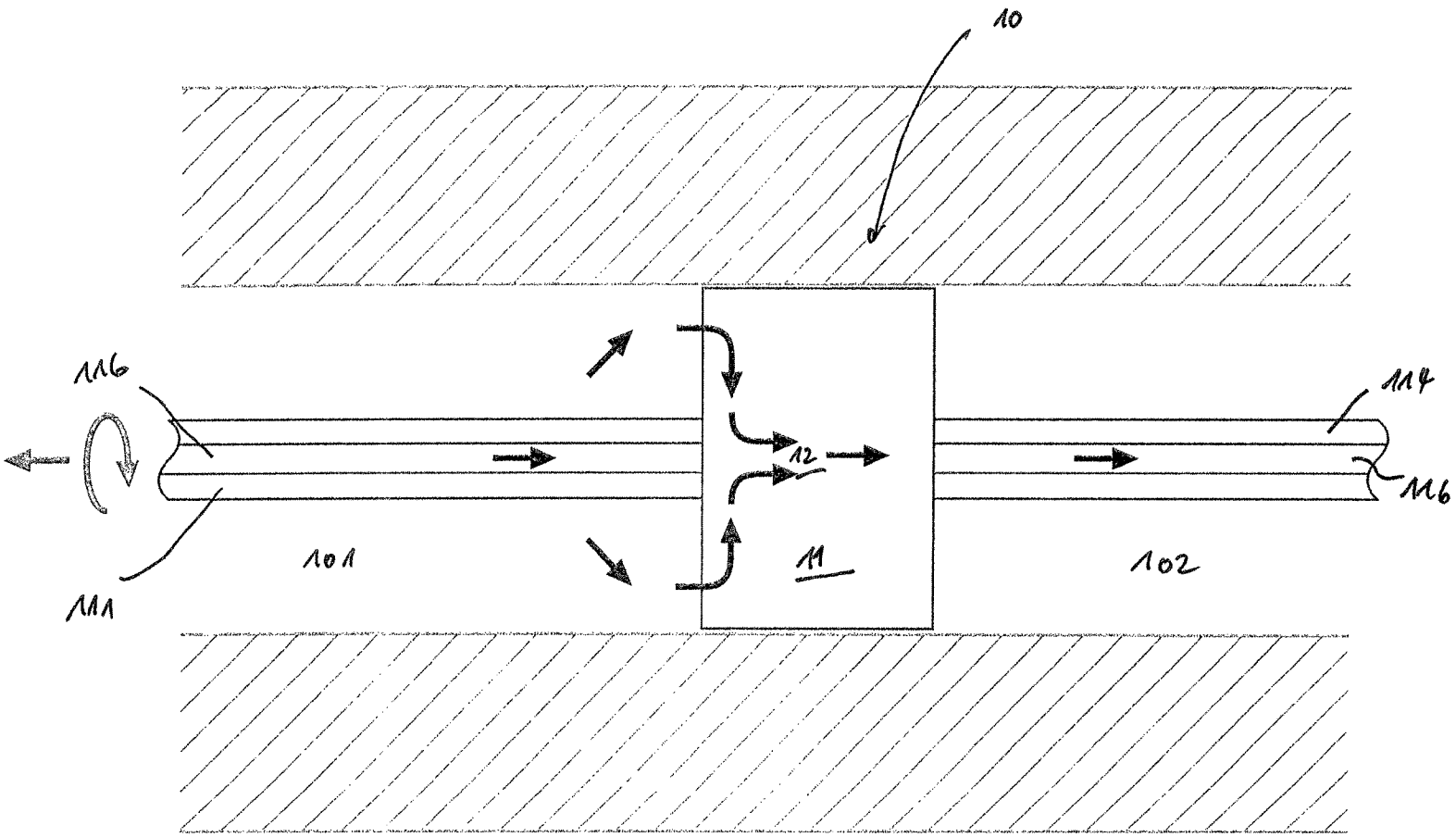

FIG. 10 shows the apparatus 10 being used, without a drill bit 113, in the form of a scraping insert. This is done in order to clean the drill hole as such. In this case, the drilling fluid exits from the drill string 111 and, as described in FIG. 8, passes via the receiving elements 13, through the openings 14, into the receiving chambers 17 and from there, taken in by suction via the pump 12, 27, into the mixing chamber 31 and on into the mixing tube 34, from where it is then discharged into the interior 116 of the drill string 114 and is removed from the drill hole 101, 102.

Figure 11:
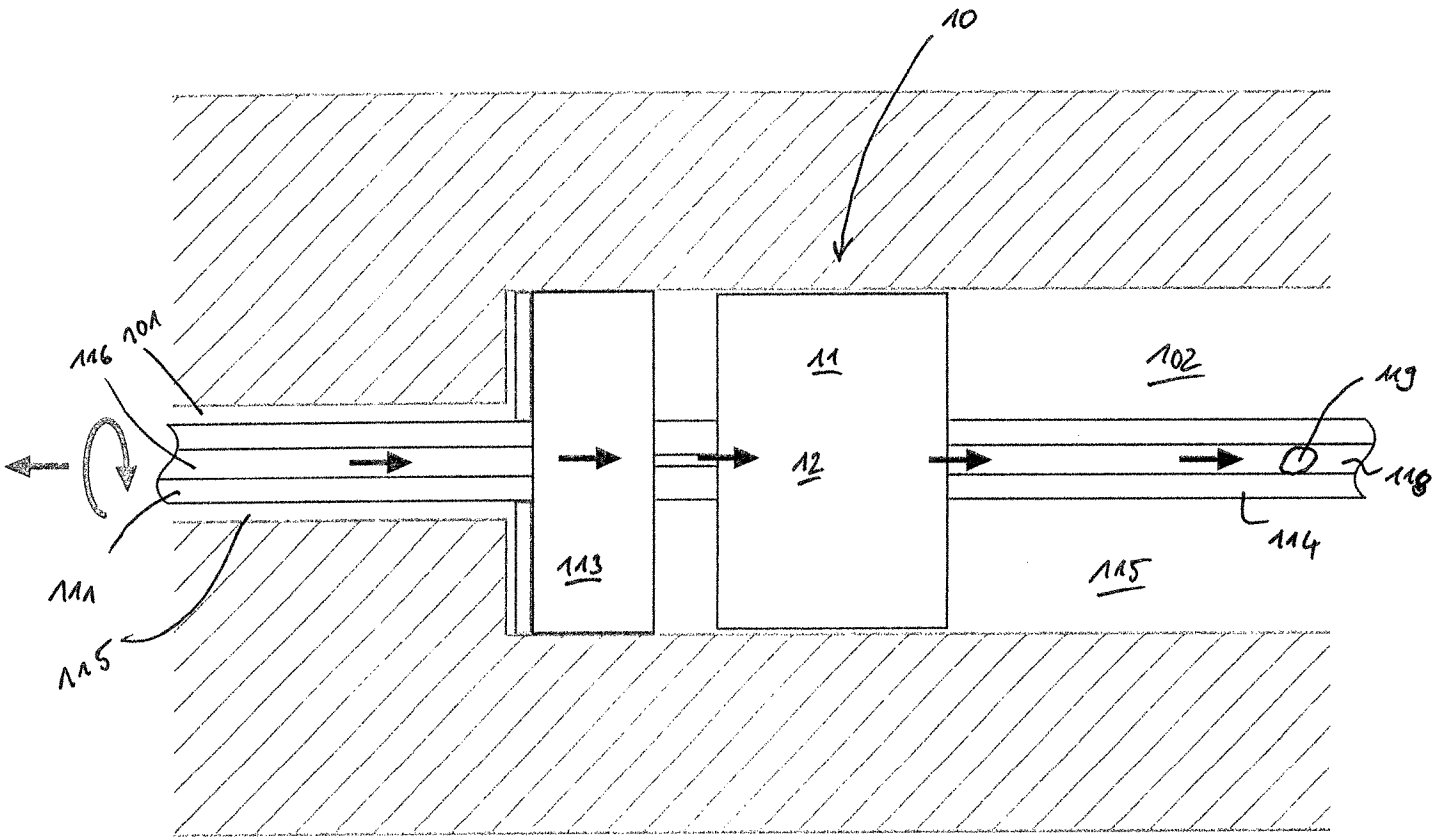

FIG. 11 shows a specific case in which there is a blockage 119 within the interior 118 of the drill string 114. The nozzle 32 here, as illustrated in FIG. 7, is moved, by the increase in pressure in the interior 116, 118, against the mixing tube 34, and the mixing chamber 31 is thus closed. All of the drilling fluid 115 located in the interior 116 of the drill string 111 is pumped into the pump 12, and correspondingly accelerated there, and therefore, possibly along with a simultaneous increase in the pressure in the pump (not illustrated) in the drilling rig 110, the blockage 119 is loosened and transported away from the interior 118 of the drill string 114.

FIG. 12 shows a further specific case, in which the openings 14 of the receiving elements 13 have to be cleaned. A valve (not illustrated), which is closed, is located at the end of the drill string 114. This means that it is no longer possible for the drilling fluid 115 to be moved forward through the interior 118 of the drill string 114. A flow reversal thus takes place in the mixing chamber 31, and therefore the drilling fluid takes place, through the suction-intake connection 33, into the suction-intake connection 18 and, from there, into the receiving chamber 17. From here, the drilling fluid 115 exits, through the openings 14, into the drill-cuttings region 117. In this region, the pressure within the drilling fluid 115 increases and said drilling fluid then flows through the bypass 26, past the receiving body 11, into the drill hole 102. This makes it possible, as a result of appropriate pressure adaptation and back-flushing, to free the openings 14 of blockages and of contaminants.

FIG. 13 shows the case in which the apparatus 10 is used as a drilling apparatus. This case corresponds to that shown in FIG. 8, with the exception that the earth is loosened by drilling tools (not illustrated) and removed directly via the receiving element 13.

FIG. 15, furthermore, shows a layout of site facilities on the side from which, following completion of drilling, the pipeline (not illustrated) is introduced. Here, the drilling mud 115 is removed from the drill string 114. For this purpose, a wagon 120 is positioned on a slide 121. The wagon 120 has a rotary articulation installed (not illustrated) and is constructed such that it absorbs the rotary movement (torsional forces) from the drill string 114. The drilling mud 115 is channeled via a hose 122 and a hose guide 123 of the slide 121. If a new pipe section 126 has to be added, the wagon 120 is drawn upward with the aid of a cable winch 124, in conjunction with a drive 127, and the new pipe section 126 can be added. A clamping unit 125 ensures that the pipe section which is to be added is secured and the necessary torque for closing a thread 128 can be applied via the drilling rig 110. The slide 121 can be adapted to the inclination of the drill string 114 via an adjustable substructure. The slide 121, in addition, contains the necessary measuring devices (not illustrated), such as flowmeters and pressure sensors, which are necessary for controlling the system.

LIST OF DESIGNATIONS

10 Apparatus
11 Receiving body
12 Pump
13 Receiving element
14 Opening
15 Receiving surface
16 Directing element
17 Receiving chamber
18 Suction-intake connection
19 Rear chamber wall
20 Side chamber wall
21 End wall
22 Cylinder wall
23 Rear wall
24 Opening
25 Bore
26 Bypass
27 Liquid jet pump
28 Drill-string connection
29 Drill-string connection
30 Central part
31 Mixing chamber
32 Nozzle
33 Suction-intake connection
34 Mixing tube
35 Diffuser
36 Flange
37 Flange
38 Flange
39 Bolt
40 Receiving tool
41 Beveled portion
42 Receiving-tool element
43 Cutout
44 Buoyancy space
45 Exit
100 Earth
101 Drill hole
102 Drill hole
103 Starting point
104 Destination point
105 Obstruction
106 Drilling line
110 Drilling rig
111 Drill string
112 Drilling apparatus
113 Drill bit
114 Drill string
115 Drilling fluid
116 Interior
117 Drill-cuttings region
118 Interior
119 Blockage
120 Wagon
121 Slide
122 Hose
123 Hose guide
124 Cable winch
125 Clamping unit
126 Pipe section
127 Drive

The invention claimed is:

1. An apparatus for removing drill cuttings loosened by a drilling tool during the operation of producing a drill hole for laying a pipeline, comprising at least one pump for pumping out drilling fluid mixed with the drill cuttings, and at least one receiving body with at least one receiving chamber, which is connected to a drill-cuttings region behind the drilling tool via openings, wherein a receiving element on the receiving body is configured to receive the drill cuttings mechanically and on which are disposed at least one of the openings via which the drill cuttings pass into the receiving chamber, wherein the receiving body has at least one bypass for bypassing the receiving body and wherein the bypass at least one of comprises a receiving tool on the rear side of the receiving body, or is configured to minimize the through-passage of drill cuttings during drilling operation and to allow through-passage of drill cuttings during removal operation.

2. The apparatus as claimed in claim 1, wherein the surface area of the openings is configured to pass drill cuttings through the openings without suction-intake action.

3. The apparatus as claimed in claim 1, comprising a suction intake opening in the receiving chamber for the hydraulic suction intake of the drill cuttings into the pump.

4. The apparatus as claimed in claim 1 comprising at least two receiving elements and at least two receiving chambers.

5. The apparatus as claimed in claim 1 wherein the receiving body is a float with at least one air-filled portion.

6. The apparatus as claimed in claim 1 wherein the diameter of the receiving body is substantially the diameter of the drill hole.

7. The apparatus as claimed in claim 1, wherein the bypass has one of a helical or rectilinear portion, and the bypass is at least one of disposed on the rear side of the receiving element, or on the outside of the receiving body.

8. An apparatus for removing drill cuttings loosened by a drilling tool during the operation of producing a drill hole for laying a pipeline, comprising at least one pump for pumping out drilling fluid mixed with the drill cuttings, and at least one receiving body with at least one receiving chamber, which is connected to a drill-cuttings region behind the drilling tool via openings, wherein a receiving element on the receiving body is configured to receive the drill cuttings mechanically and on which are disposed at least one of the openings via which the drill cuttings pass into the receiving chamber wherein the pump is a liquid jet pump comprising at least one of a nozzle, a diffuser and a mixing chamber, wherein the nozzle is configured to be movable in relation to the diffuser to close the mixing chamber.

9. The apparatus as claimed in claim 1 wherein the receiving element comprises a releasable receiving tool.

10. The apparatus as claimed in claim 1 wherein the drilling tool is disposed on one of a drilling apparatus or on the receiving body on the receiving element.

11. The apparatus as claimed in claim 1 wherein the receiving body is configured to be releasable whereby the receiving body can be changed depending on the diameter of the drill hole.

12. The apparatus as claimed in claim 1 wherein at least one of the receiving element is configured to be releasable or a receiving tool on the releasing element is configured to be releasable.

13. The apparatus as claimed in claim 8, wherein the surface area of the openings is configured to pass drill cuttings through the openings without suction-intake action.

14. The apparatus as claimed in claim 8, comprising a suction intake opening in the receiving chamber for the hydraulic suction intake of the drill cuttings into the pump.

15. The apparatus as claimed in claim 8 comprising at least two receiving elements and at least two receiving chambers.

16. The apparatus as claimed in claim 8 wherein the receiving body is a float with at least one air-filled portion.

17. The apparatus as claimed in claim 8 wherein the diameter of the receiving body is substantially the diameter of the drill hole.

18. The apparatus as claimed in claim 8, wherein the bypass has one of a helical or rectilinear portion, and the bypass is at least one of disposed on the rear side of the receiving element, or on the outside of the receiving body.

19. The apparatus as claimed in claim 8 wherein the receiving element comprises a releasable receiving tool.

20. The apparatus as claimed in claim 8 wherein the drilling tool is disposed on one of a drilling apparatus or on the receiving body on the receiving element.

21. The apparatus as claimed in claim 8 wherein the receiving body is configured to be releasable whereby the receiving body can be changed depending on the diameter of the drill hole.

22. The apparatus as claimed in claim 8 wherein at least one of the receiving element is configured to be releasable or a receiving tool on the releasing clement is configured to be releasable.

* * * * *